US008678605B2

(12) United States Patent
Leadford

(10) Patent No.: US 8,678,605 B2
(45) Date of Patent: Mar. 25, 2014

(54) TWO-COMPONENT DIRECT-INDIRECT LIGHTING SYSTEM

(75) Inventor: Kevin Franklin Leadford, Evergreen, CO (US)

(73) Assignee: ABL IP Holding LLC, Conyers, GA (US)

( * ) Notice: Subject to any disclaimer, the term of this patent is extended or adjusted under 35 U.S.C. 154(b) by 294 days.

(21) Appl. No.: 13/285,564

(22) Filed: Oct. 31, 2011

(65) Prior Publication Data

US 2013/0107502 A1 May 2, 2013

(51) Int. Cl.
*F21S 8/02* (2006.01)

(52) U.S. Cl.
USPC ..... 362/147; 362/217.05; 362/246

(58) Field of Classification Search
USPC ..... 362/16, 102, 147, 217.02, 217.05, 241, 362/245, 246, 247, 296.01, 330, 347
See application file for complete search history.

(56) References Cited

U.S. PATENT DOCUMENTS 5,988,829 A * 11/1999 Holder ..... 362/223
8,002,446 B1 * 8/2011 Plunk et al. ..... 362/364

OTHER PUBLICATIONS

U.S. Appl. No. 13/285,564, filed Oct. 31, 2011, 29 pages.
Philips, *Virage*™. Tupelo, Mississippi: Philips Day-Brite, 2010. Print.

* cited by examiner

*Primary Examiner* — David V Bruce
(74) *Attorney, Agent, or Firm* — Kilpatrick Townsend & Stockton LLP

(57) ABSTRACT

A two-component light fixture that includes a passive component and an active component is disclosed. In some embodiments, the active component is recessed within a ceiling or wall and the passive component is positioned below the active component. The active component emits light towards the passive component, which includes an optical element that can redirect the light by scattering, reflection, refraction, diffusion, total internal reflection and/or dispersion.

19 Claims, 6 Drawing Sheets

TWO-COMPONENT DIRECT-INDIRECT LIGHTING SYSTEM

FIELD

The present subject matter relates generally to two-component light fixtures.

BACKGROUND

Lighting equipment designed for illuminating office-like interiors is often categorized by how it is mounted. Some products are recessed within the ceiling structure and others are suspended from the ceiling structure. One common ceiling type is a suspended grid system with lay-in acoustic tile. Lighting fixtures are recessed within the ceiling and emit light downwardly into the surrounding space. These systems are called "direct lighting" systems because they provide illumination directly to the surfaces within the architectural spaces below.

Suspended general illumination lighting equipment typically emits most of its light upward so as to light the ceiling from which the luminaires are suspended. In this approach, the architectural space is indirectly illuminated by light reflected off the ceiling. Hence, this approach is referred to as "indirect lighting." Some of this type of equipment also provides a component of downward emission and therefore is sometimes called "indirect-direct lighting" or "direct-indirect lighting"—though it is generally still categorized as "indirect lighting."

SUMMARY

Embodiments of the invention include a two-component light fixture that includes a passive component and an active component. In some embodiments, the active component is recessed within a ceiling or wall and the passive component is positioned adjacent the active component. The active component can direct light toward the passive component, which includes an optical element that can redirect light in a highly controlled manner by directing light upward and/or downward to produce a variety of useful photometric distributions.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, and or all drawings and each claim.

BRIEF DESCRIPTION OF THE DRAWINGS

Illustrative embodiments of the present invention are described in detail below with reference to the following figures.

DETAILED DESCRIPTION OF THE INVENTION

Figure 1:
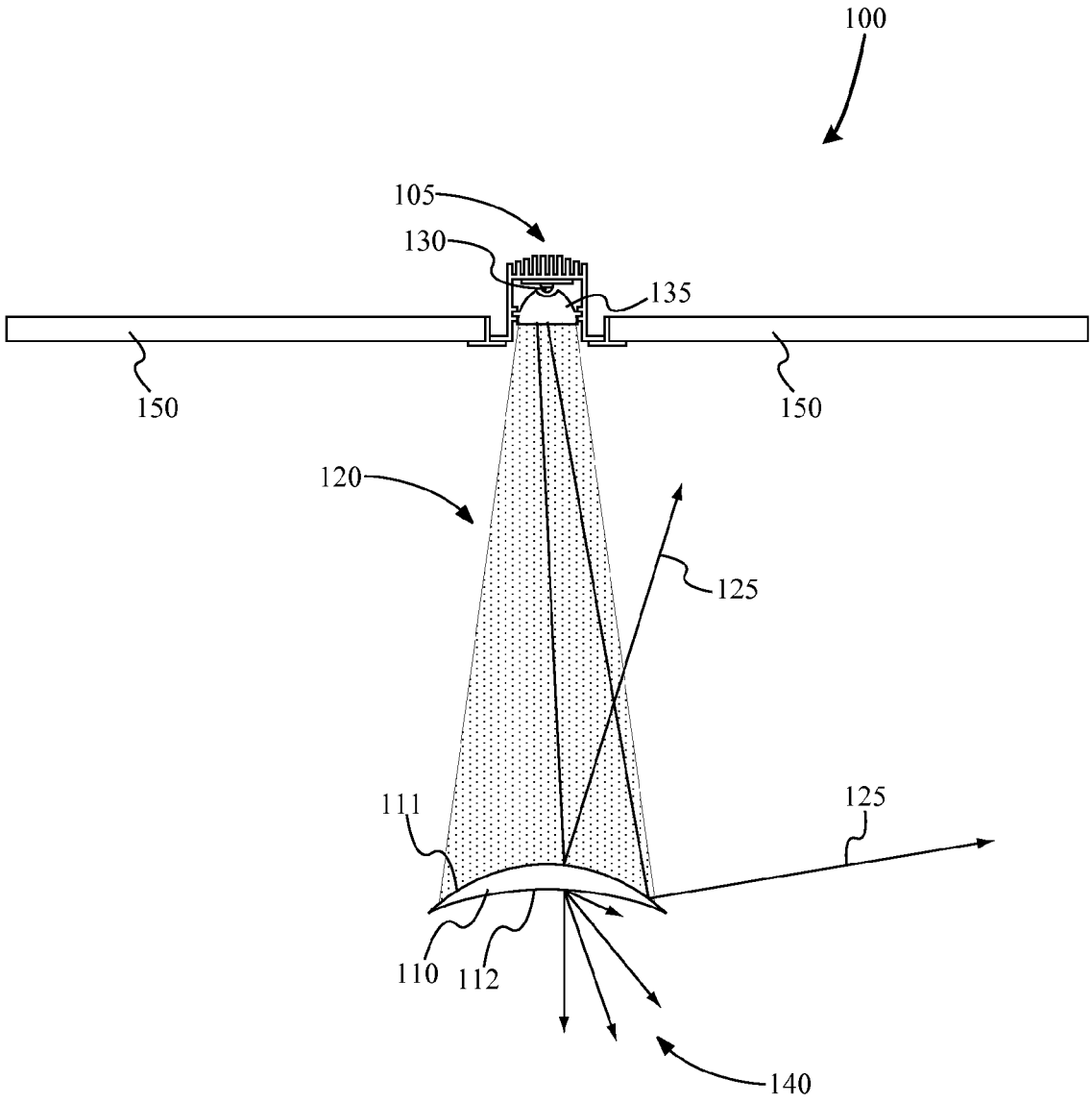
FIG. 1 is an end view of a two-component lighting system according to an embodiment of the invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Like numerals within the drawings and mentioned herein represent substantially identical structural elements. Each example is provided by way of explanation, and not as a limitation. For instance, features illustrated or described as part of one embodiment may be used on another embodiment to yield a further embodiment. Thus, it is intended that this disclosure includes modifications and variations.

Two-component lighting systems are disclosed according to various embodiments of the invention. These systems generally include an active component and a passive component. In use, the active component, for example, can be recessed within a ceiling, a wall, a fixture, etc., while the passive component can be suspended or otherwise positioned a distance away from the active component with a suspension mechanism (or positioning mechanism). The active component can include light source(s), focusing optics, power converters, wires, control circuitry, power sources, housings, heat sinks, mounts, and/or flanges, etc. The active component can be recessed in such a way that the components are concealed within the ceiling and/or wall. Optics within the active component can direct light from the light source(s) through an aperture in the active component toward the passive component.

The passive component can be suspended or positioned a distance from the active component. The passive component can be designed to redistribute the light from the active component both angularly and spatially to provide general illumination to an interior architectural space. The passive component can redirect the light upward and/or downward. During redirection the light can undergo one or more of refraction, reflection, scattering, diffusion, polarization change, total internal reflection, or any other optical phenomena caused by the passive component. That is, in some embodiments, the passive component can be completely or partially transparent and/or translucent, which allows the passive component to provide direct lighting to the architectural space. In some embodiments, the passive component can redirect light downward with an angular profile that reduces glare. In some embodiments, the passive component can be partially or completely opaque (or reflective) and can redirect light upward to provide indirect lighting within the architectural space. In some such embodiments, the passive component can redirect light upward with an angular profile that distributes light broadly across the ceiling, wall or fixture where the first component is recessed. In some embodiments, the passive component can redirect light both upward and downward using any combination of the embodiments described above.

The light source(s) used within the active component and described in conjunction with any of the various embodiments of the invention can include any type of lighting source. For example, light sources can include one or more LEDs, incandescent lights, fluorescent lights, etc. As another example, the light source can include a plurality of point sources of light arranged in an array.

A suspension mechanism can be used to position the passive component a distance from the active component. For example, the suspension mechanism can be used to position the passive component a distance below a ceiling within which the active component is recessed. As another example, the suspension mechanism can be used to position the passive component a distance from a wall within which the active component is recessed. The suspension mechanism can include any type of mechanical component that positions the passive component a distance from the active component and allows the passive component to disperse light according to the various embodiments described herein. The suspension mechanism can include one or more wires, rods, pendant pipes, threaded rods, aircraft cables, threaded hardware, ropes, chords, chains, tie-wires, etc.

In some embodiments, the suspension mechanism does not include electrical wires, control wires, or the like. Because all lighting, control electronics, and power elements are housed within the active component, there is no need to direct electricity or control signals to the passive component with or as part of the suspension mechanism.

A passive component can be coupled with one or more suspension mechanisms. In some embodiments, passive component can include an optical element that is directly coupled with one or more suspension mechanisms. That is, in some embodiments, the optical element may not include a housing or mechanical structure other than the optical element. In such embodiments, an attachment mechanism can be coupled with the optical element and can then be coupled with the suspension mechanism. In some embodiments, the passive component can include an elongated optical element and two or more attachment mechanisms positioned along the length of the active component and/or at the end of the passive component. An elongated optical element can include a fixed cross-section that extends along one dimension of the optical element. In some embodiments, an attachment mechanism can be coupled at two points along the width of an elongated optical element.

A suspension mechanism can be used to position the passive component any distance from the active component. For example, the suspension mechanism can position the active component six inches to eight feet from the active component or ceiling. For low ceiling configurations the suspension mechanism can position the passive component six inches or less from the active component or ceiling. As another example, the suspension mechanism can position the passive component two to five feet from the active component or ceiling. Moreover, the suspension mechanism can position the passive component 0.5, 1, 1.5, 2, 2.5, 3, 3.5, 4, 4.5, 5, 5.5, 6.5, or 6.6 feet from the active component or ceiling. In some embodiments, the focusing optics within the active component can be tailored depending on the length of the suspension mechanism (i.e., the distance between the active and passive components) in order to properly direct light onto the passive component.

Figure 2:
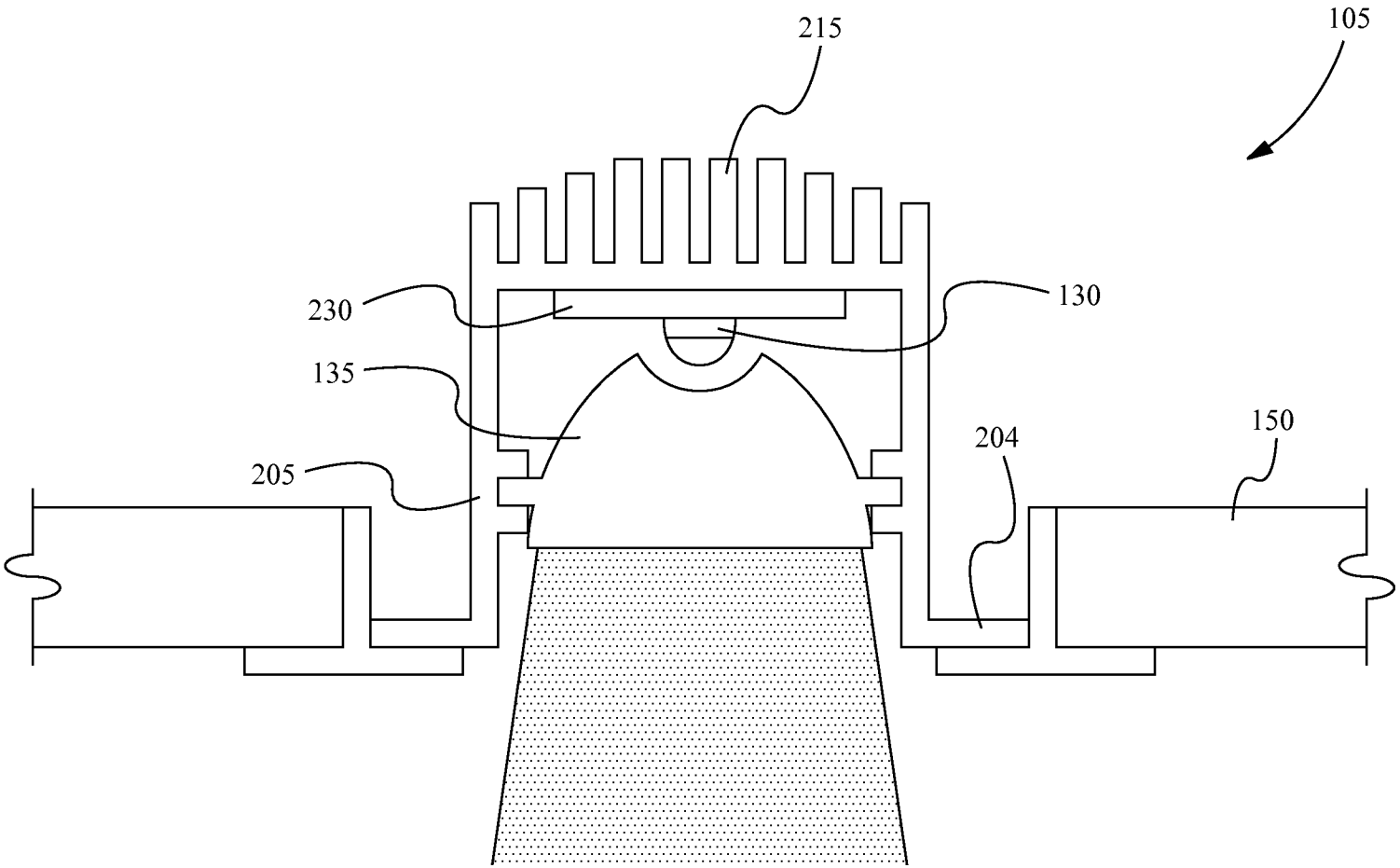
FIG. 2 is a detailed side view of an embodiment of an active component of the two-component lighting system shown in FIG. 1.

FIG. 1 is a cutaway end view of a two-component lighting system 100 according to one embodiment of the invention. Two component lighting system 100 includes active component 105 and passive component 110. A close-up of active component 105 is shown in FIG. 2. As shown in FIG. 1, active component 105 is recessed within ceiling 150. In some embodiments, active component 105 can be partially or completely recessed within ceiling 150. Active component 105 can include LED 130 and optical element 135. While LED 130 is shown within active component 105, any other light source can be used such as, for example, an incandescent light or fluorescent light. LED 130 can be one of a plurality of LEDs arranged in an array, for example, a linear array of LEDs. Also, while optical element 135 is shown within active component 105, any number of lenses, filters or the like may be used.

Light from LED 130 is directed (e.g., focused and/or collimated) by optical element 135 toward passive component 110. Optical element 135 distributes light across a width of passive component 110. One or more optical elements together can distribute light along the length of passive component 110. In other embodiments, optical element 135 may distribute light 120 across or onto specific portions of passive component 110. In some embodiments, light 120 can be collimated using optical element 135.

The cross-sectional shape of passive component 110 in this embodiment has a generally convex shape in relation to active component 105. Passive component 110 can include top surface 111 and bottom surface 112 each extending along the width and length of the passive component. Top surface 111 can be convex with a radius of curvature that is smaller than the radius of curvature of bottom surface 112. Top surface 111 and bottom surface 112 can meet at the sides of the passive component along the length of passive component 110. The sides of passive component 110 where top surface 111 and bottom surface 112 meet can be sharp or rounded. In some embodiments, the top surface 111 and bottom surface may not come into contact at the sides. Instead, passive component 110 may have a thickness with sides that give the passive component depth.

Figure 5:
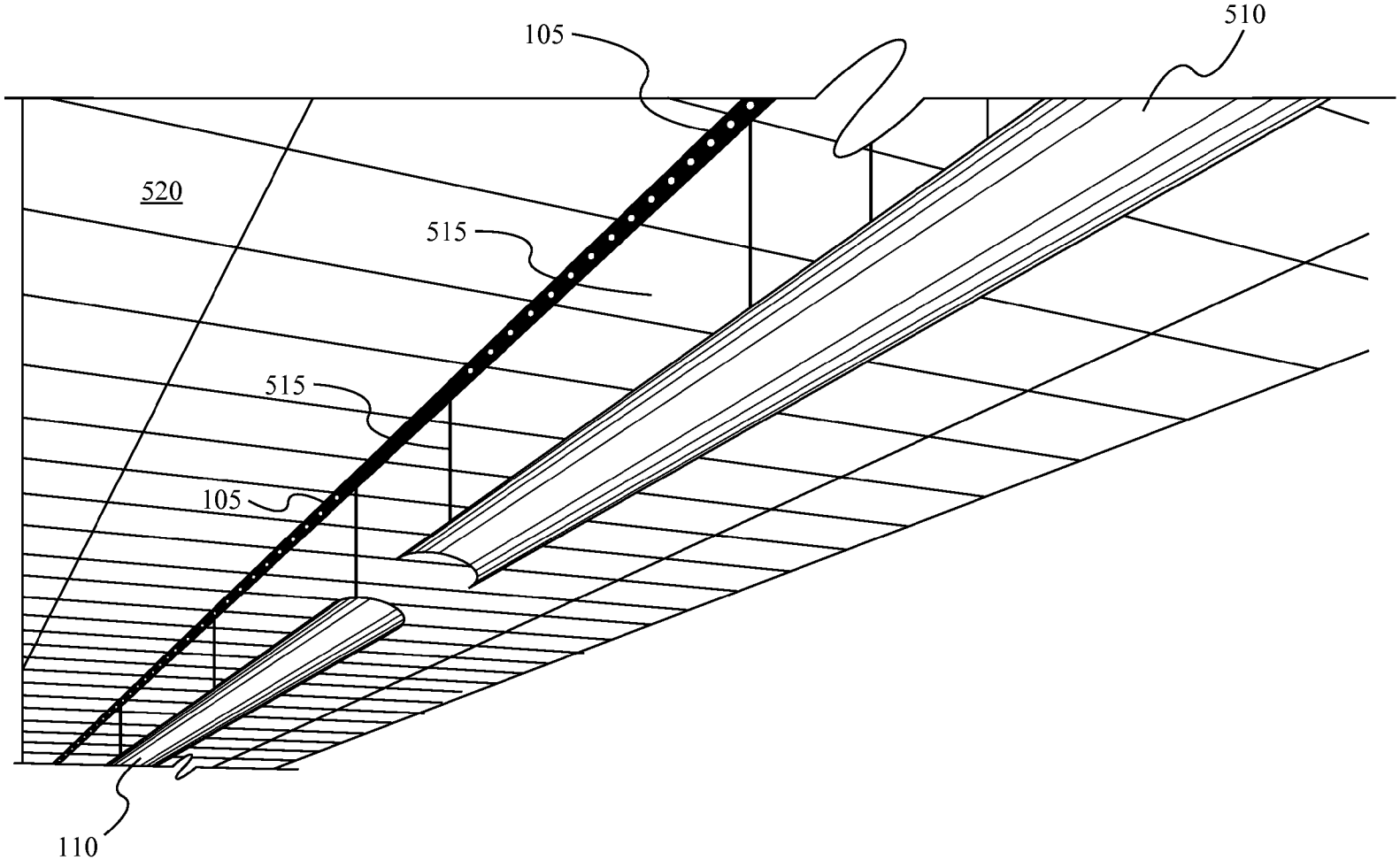
FIG. 5 illustrates an embodiment of a two-component lighting system attached to a ceiling.

Passive component 110 can be an elongated member like those shown in FIG. 5. Passive component 110 can have a length that is much longer than the width and/or height. Passive component 110 can have a length, for example, that can be more than 4 times its width and/or height. Passive component 110 can have a length, for example, that can be more than 6, 8, 10, 12, or 14 times its width and/or height. Passive component 110 can have a width, for example, that can be more than 2, 4, 6, 8, or 10 times the height. The height can refer to the height of the optical element or the entire passive component.

Passive component 110 can include a plurality of attachment members. These attachment members can attach with a suspension mechanism (not shown in FIG. 1) that positions passive component 110 a distance from active component 105. Attachment members may be arrayed along the length of an elongated passive component 110 or coupled at opposite ends of passive component 110. In some embodiments, attachment members can couple directly with active component 105 and/or can couple with ceiling 150.

Passive component 110 can be used to redirect light upward and/or downward. For example, as shown in FIG. 1, light 125 has been redirected upward by passive component 110, and light 140 has been redirected downward. During redirection the light can undergo one or more of refraction, reflection, scattering, diffusion, polarization change, total internal reflection, or any other optical phenomena caused by the passive component. In this embodiment, passive component 110 can be partially opaque and/or reflective causing some light to be redirected toward ceiling 150, and partially transparent, translucent, refractive and/or transmissive allowing some light to pass through passive component 110 and be distributed toward the floor. In some embodiments, light is redirected by passive component 110 toward ceiling 150 to indirectly illuminate the architectural space. In some embodiments, light is distributed by passive component 110 to uniformly illuminate the ceiling or wall. In some embodiments, passive component 110 can minimize light redirection toward active component 105. Instead, light is spread broadly and/or evenly over the ceiling 150. In some embodiments, passive component 110 can illuminate the ceiling relatively uniformly when applied as a system.

In some embodiments, light 140 is redirected downward by passive component 110 to directly illuminate portions of the architectural space. Light 140 can be redirected downward with the majority of light concentrated below a given angle to reduce the potential for glare. The majority of light concentrated below a given angle can be less than 95%, 90%, 85%, 80%, 75%, 65%, 60%, etc. In some embodiments, the downward light maybe concentrated over angles less than 65° measured from nadir. In other embodiments, the downward light maybe concentrated over angles less than 55° measured from nadir. In yet other embodiments, the downward light maybe concentrated over angles less than 45° measured from nadir.

In some embodiments, passive component 110 can redirect the majority of light 120 upward at shallow angles. In some embodiments, shallow angles are angles between 60° and 90° measured from zenith. In some embodiments, shallow angles are angles between 65° and 85° measured from zenith. In some embodiments, shallow angles are angles between 70° and 80° measured from zenith.

Passive component 110 can include standard optical materials including glass, acrylic, polycarbonate, plastic, Plexiglas, metal, etc. Passive component 110 can include mounting hardware and/or attachment mechanisms to couple with the suspension mechanism. In some embodiments, suspension mechanism and/or mounting hardware can couple directly with passive component 110.

While passive component 110 is shown in FIG. 1 as having a convex cross section, any type of cross section may be used. For example, passive component 110 can be convex, concave, planar, and/or any combination thereof. Passive component 110 can also have any number or types of surfaces such as, for example, flat surfaces, concave surfaces, convex surfaces, and/or surfaces with any number of geometric shapes. Multiple passive components can be used arranged in various patterns. Passive component 110 can have multiple layers, portions with different structures, etc.

Active component 105 is shown in more detail in FIG. 2. Generally speaking, active component 105 can include all the power, control, light generation, primary optics, electronics, thermal management, and/or housing components in a recessed manner within ceiling 150. Active component 105 can include housing 205 that includes heat sink 215. LED 130 is disposed on circuit board 230, both of which are disposed within housing 205 near or in thermal contact with heat sink 215. Optical element(s) 135 or an array of optical elements 135 can be positioned within housing 205 relative to LED(s) 130. Housing 205 includes flange 204 that can be used to couple with ceiling 150 and recess housing 205 within ceiling 150. In some embodiments, the majority, if not all, of the components are disposed above flange 204 and/or other mounting hardware. Flange 204 may extend below ceiling 150 or be completely recessed within ceiling 150. Flange 204 can have various sizes or shapes for various design considerations. In some embodiments, flange 204 can have a large exposed portion that can serve as a deliberate mechanism for organizing and cleaning up the appearance of the ceiling. Various other mechanisms may be used to secure housing 205 recessed within ceiling 150.

Figure 3:
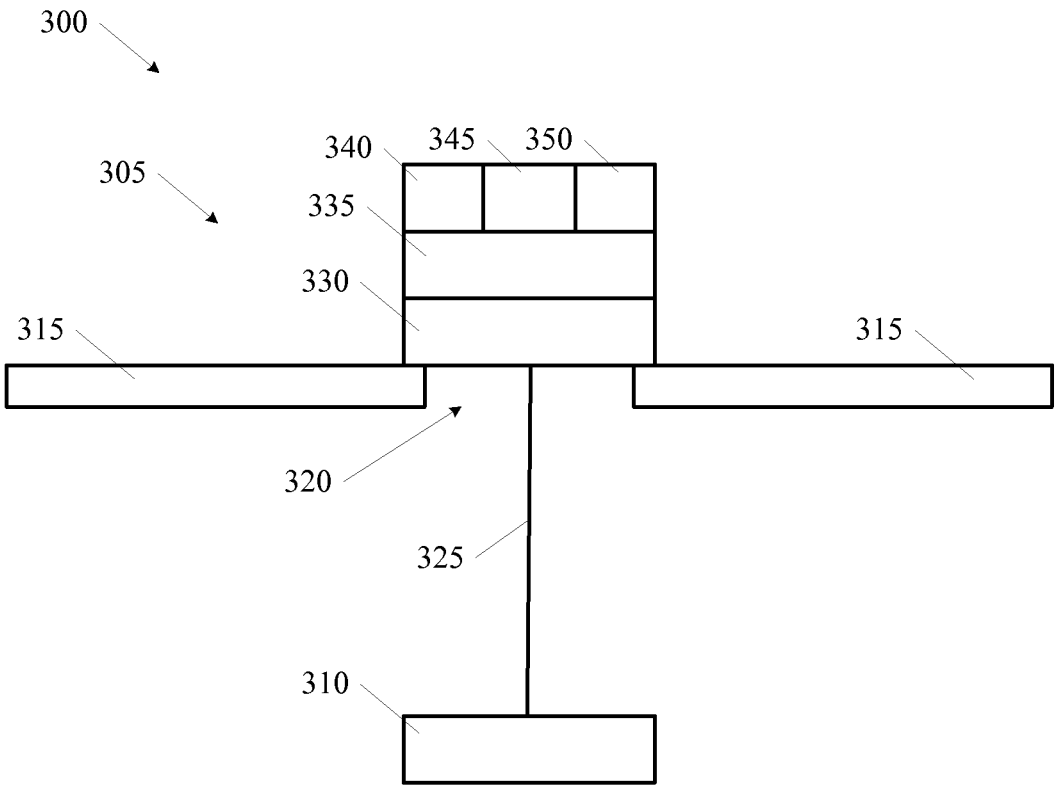
FIG. 3 is a block diagram of a general lighting system according to an embodiment of the invention.

FIG. 3 is a block diagram of a general lighting system according to the various embodiments of the invention. Active component 305 is recessed within ceiling 315 (or wall, or fixture) and passive component 310 is positioned a distance from ceiling 315 with suspension mechanisms 325 (one is shown although any number can be used). Active component 305 can house a number of operational components, including, but not limited to, optical element(s) 330, light source(s) 335, power source 340, control 345, and/or thermal management 350. These components can be disposed within ceiling 315. Light is directed from active component 305 through recess 320 toward passive component 310. Active component 305 can be positioned flush with, above, or protruding below the top or bottom surface of ceiling 315.

Figure 4:
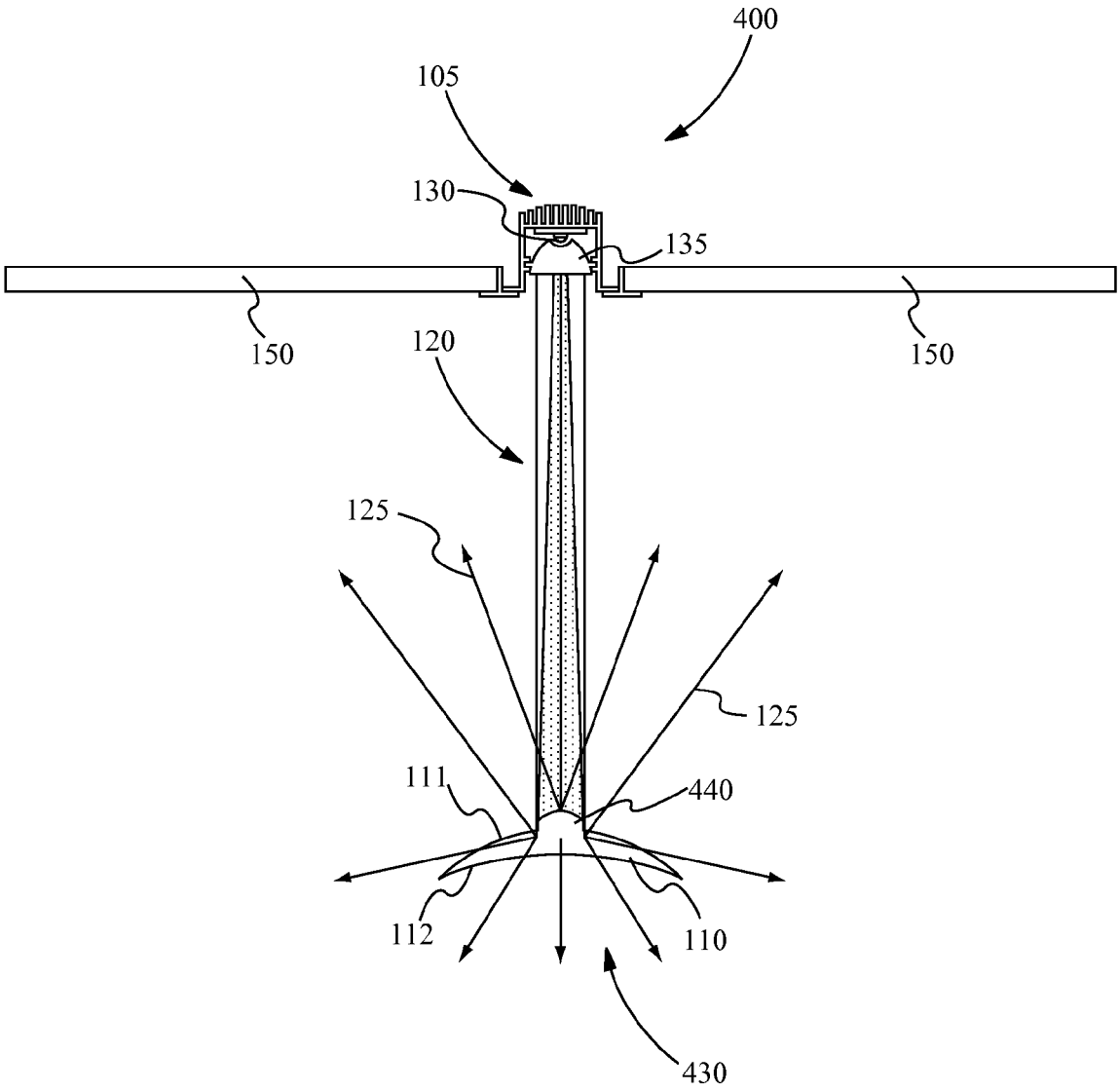
FIG. 4 is a side view of a two-component lighting system according to another embodiment of the invention.

FIG. 4 shows another cutaway side view of two-component lighting system 400 according to some embodiments of the invention. Active component 105 can be similar to active component 105 shown in FIG. 1 and FIG. 2. In this embodiment, however, active component 105 directs light 120 toward passive component 110 in a more focused manner. That is, it primarily illuminates a specific, typically central, portion of passive component 110. Like the embodiment shown in FIG. 1, light 120 is incident on passive component 110, which redirects light upward toward the ceiling and/or redirects the light downward. Thus, a two-component lighting system can provide both indirect and direct lighting. In other embodiments, passive component 110 can only redirect light upward or can only redirect light downward. Passive component 110 can be substantially convex shaped and may include a central structure 440. Central structure 440 can be decorative and/or provide an optical control to the redirected light.

While some embodiments have been described as redirecting light upward and/or downward from the passive optical element, in some embodiments of the invention, light can enter the top surface of the passive optical element and be piped through the body of the passive optical elopement. In some embodiments, piped light can exit the optical element through the top surface and/or the bottom surface. In some embodiments, the piped light can exit the optical element through the sides of the optical element.

FIG. 5 shows two runs of linear, two-component lighting systems in use according to some embodiments of the invention. Active component 105 is recessed within ceiling 520 and passive component 110 is shown suspended from active component 105. Active component 105 is linear and extends parallel with passive component 110. Passive component 110 is suspended from ceiling with suspension mechanisms 515. In this example, a plurality of suspension mechanisms 515 are shown coupled with a single passive component 110. In some embodiments, however, one or two suspension mechanisms can be used to suspend a single passive component 110 from active component 105. In some embodiments, suspension mechanisms 515 can be coupled with both active component 105 and passive component 110. Active component 105, in this embodiment, includes a plurality of LEDs arranged linearly along the length of active component 105. Active component 105 is also disposed recessed within ceiling 520. In some embodiments, suspension mechanisms 515 can attach to active component 105 within a recess within ceiling 520. In some embodiments, suspension mechanisms 515 can couple directly with the ceiling or any other structural support.

Passive component 110 can angularly control the distribution of light in a number of different ways. For example, passive component 110 can control the redirection of light from active component 105 toward ceiling 150. This controlled redirection can direct light across the ceiling. In some embodiments, this controlled upward redirection can have a large horizontal component. That is, the controlled redirection can distribute light along the ceiling at low to medium angles relative to the horizontal. In some embodiments, the controlled redirection can direct light across the ceiling in a visually uniform manner, alone or when applied as a system. This controlled redirection can produce a comfortable indirect lighting effect. In some embodiments, this controlled redirection can occur in a direction parallel or nearly parallel with the linear light system. In some embodiments, this controlled redirection can occur in a direction perpendicular or nearly perpendicular with the linear light system. In some embodiments, controlled redirection can occur in all directions azimuthally.

As another example, passive component 110 can control the redirection of light from active component 105 toward the floor. This controlled redirection can direct light toward the floor. That is, the controlled redirection downward can have a large vertical component and/or a batwing photometric distribution. In some embodiments, the controlled redirection directs light toward the floor in a visually uniform manner, alone or when applied as a system. This controlled downward redirection can produce a comfortable direct lighting effect without high angle glare issues. In some embodiments, this controlled redirection can occur in a direction parallel or nearly parallel with the linear light system. In some embodiments, this controlled redirection can occur in a direction perpendicular or nearly perpendicular with the linear light system. In some embodiments, controlled redirection can occur in all directions azimuthally.

Figure 6:
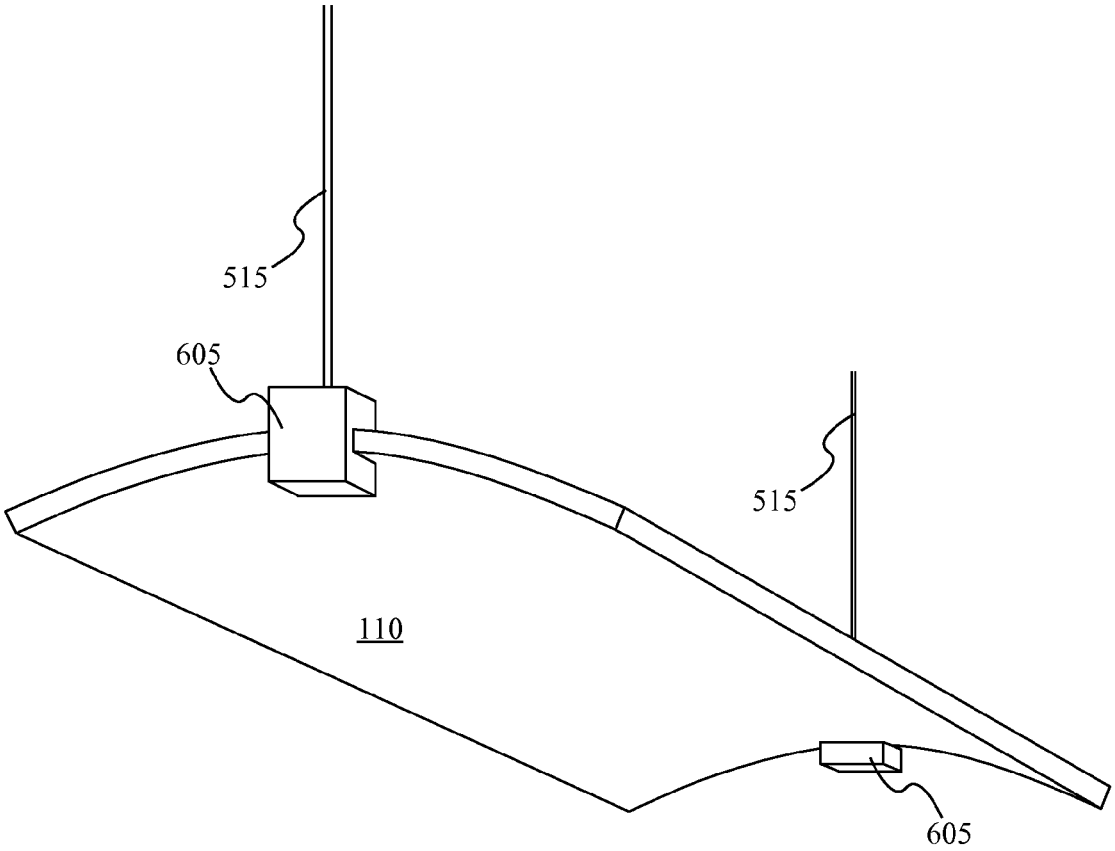
FIG. 6 is a bottom perspective view of an embodiment of a passive component of a two-component lighting system according to an embodiment of the invention coupled with an embodiment of an attachment mechanism.

FIG. 6 shows attachment mechanisms 605 coupled with two opposite ends of passive component 110. Attachment mechanisms 605 can be any device that couples passive component 110 to suspension mechanisms 515. Because passive component 110 may be constructed from transmissive or translucent materials (e.g., glass or plastics), attachment mechanism 605 may use friction and/or pressure to couple with passive component 110. Attachment mechanism 605 can be constructed from any type or material such as metal or plastic. Attachment mechanisms 605 can have any shape or function that couples suspension mechanism 515 with passive component 110. In this particular embodiment, attachment mechanism 605 can include a slot within which passive component 110 can slide and be secured.

Figure 7:
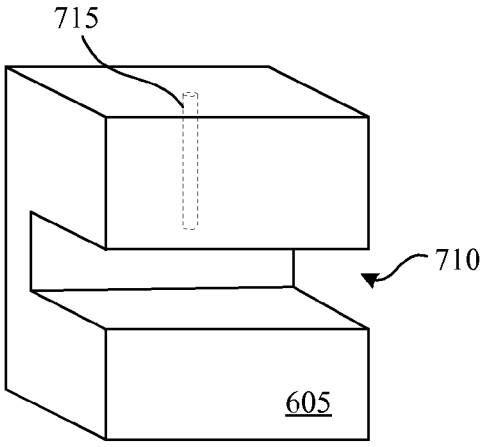
FIG. 7 is a top perspective view of the attachment mechanism shown in FIG. 6.

FIG. 7 shows attachment mechanism 605 according to some embodiments of the invention. Attachment mechanism 605 can include slot 710 configured to mate with passive component 110. That is, slot 710 can have a height that is the same as or slightly larger than the thickness of a portion of passive component 110. In this way, passive component 110 can slide within slot 710. Attachment mechanism 605 may also include a threaded or partially threaded hole 715 within which a screw or bolt can be threaded onto or into passive component 110. This screw or bolt can provide pressure and/or friction on passive component 110 that keeps passive component 110 secure within attachment mechanism 605. Various other techniques may be used to secure passive component 110 with attachment mechanism 605.

While a two-component system with a linear form factor is described, embodiments of the invention may include non-linear form factors. For instance, square, rectangular, circular, ringed, disc, donut-shaped, and/or oval components may be used. In such non-linear embodiments, light from the active component can be focused and/or collimated toward the non-linear passive component.

Embodiments of the invention disclose a two-component light system with an active component recessed within a ceiling. However, portions of the active component may extend below the ceiling plane. For example, flanges, mounts, suspension connectors, etc., may extend below the plane of the ceiling. Moreover, mechanical, installation or aesthetic components may also extend below the ceiling plane. In some embodiments, the active component can be surface mounted instead of recessed.

The two-component lighting system disclosed herein can allow for added design flexibility with respect to the size, shape and material composition of the passive component body. The increased design flexibility extends not just to the physical form of the passive component, but to its lit appearance and luminous composition as well. For example, embodiments of the invention can allow designs with passive component having a higher percentage of surface area which is luminous or glowing and possibly translucent or transparent as opposed to opaque and non-emissive. These portions can also be designed to create elements of sparkle or shimmer and other dynamic luminous qualities. Embodiments of the invention can also allow for portions of the passive component to be open space if desired.

Moreover, some embodiments of the invention allow for the passive component to be smaller and/or more shallow than prior art fixtures because the passive element need not include the operational components of the fixture, such as the power source, controls, light source(s), etc. It may also afford designs which are actually larger in size (e.g., to reduce glare by distributing luminance over a larger area) or designs with more complicated forms for aesthetic opportunities without the negative perception of undue weightiness or bulk from which prior art fixtures suffered. Likewise, the invention may also allow suspended indirect lighting to be more successfully applied to spaces with lower ceiling heights.

Locating the elements of light generation behind the ceiling plane not only eliminates the need for the passive component to conceal these items from view, but also the structural considerations to house them, support and balance their weight, and provide any needed electrical and thermal isolation. In this way, the design of the passive component can focus exclusively on qualities related directly to lighting quality (e.g., photometric distribution, glare reduction, desired proportion of direct and indirect illumination, etc.) and aesthetics (form, style, materials, luminous composition, architectural integration, etc.). A significant portion of the total required optical manipulation can be off loaded to the active component of the system since it can provide a high degree of collimation and present the passive component with a light field that is already highly spatially and angularly organized and controlled.

A two-component lighting system can also be used to conveniently and discretely house and integrate additional lighting equipment (e.g. wall washing, emergency egress, and/or accent lighting) as well as other building systems (e.g. fire sprinklers, smoke detectors, HVAC air handling functions, surveillance and alarm systems, etc.) that would normally require separate installation to the walls or ceiling of the space. By designing the recessed component of the invention to be able to integrate these functions and devices, the visual clutter usually associated with them can be greatly diminished or eliminated. In addition to integrating these devices within the active component of the invention, they can also be placed in a standalone housing(s) that does not project light to a second component, but otherwise has a mounting method, shape, color, trim style, aperture appearance and overall visual integration with the ceiling that matches or complements the active component of the invention.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A two-component light fixture comprising:

an active component comprising a housing, a light source, and a primary optic, wherein the light source and the primary optic are disposed within the housing, and the primary optic is disposed relative to the light source to focus light emitted from the light source;

a passive component comprising a secondary optic that receives the focused light from the active component and redirects the focused light, wherein:

the passive component redirects a portion of the focused light received from the active component upward toward the ceiling, and the redirected light includes a photometric distribution that distributes light along the ceiling at shallow angles; and a suspension mechanism coupled with the active component and the passive component and configured to suspend the passive component a distance from the active component.

2. The two-component light fixture according to claim 1, wherein the light source comprises a plurality of light sources.

3. The two-component light fixture according to claim 1, wherein the passive component redirects a portion of the focused light received from the passive component downward toward the floor.

4. The two-component light fixture according to claim 3, wherein the redirected light in the zone of 65 to 90 degrees from nadir is less than 15% of the total light redirected downward.

5. The two-component light fixture according to claim 1, wherein the passive component redirects a portion of the focused light received from the active component upward toward the ceiling.

6. The two-component light fixture according to claim 5, wherein the redirected light has a high concentration of light in the angular range from 60 to 85 degrees relative to zenith.

7. The two-component light fixture according to claim 1, wherein the suspension mechanism suspends the passive component six inches to eight feet from the active component.

8. The two-component light fixture according to claim 1, wherein:

the housing comprises an elongated housing;

the light source comprises a plurality of light sources that emit light from positions distributed along the length of the elongated housing; and the primary optic comprises a plurality of primary optics that focus light from one of the plurality of light sources along the length of elongated housing.

9. The two-component light fixture according to claim 1, wherein the passive component comprises a substantially convex cross-sectional shape relative to the active component.

10. The two-component light fixture according to claim 1, wherein the housing comprises an aperture through which the focused light is directed toward the passive component.

11. The two-component light fixture according to claim 1, wherein the active component further comprises one or more of the following: a power supply, control electronics, and a heat sink.

12. A two-component light fixture comprising:

an active component comprising a housing, a light source, and a primary optic, wherein the light source and the primary optic are disposed within the housing, and the primary optic is disposed relative to the light source to focus light emitted from the light source;

a passive component comprising a secondary optic that receives the focused light from the active component and redirects the focused light; and a suspension mechanism coupled with the active component and the passive component and configured to suspend the passive component a distance from the active component;

wherein the housing comprises a flange configured to couple the housing within a ceiling structure.

13. The two-component light fixture according to claim 12, wherein the light source and the primary optic are disposed within the housing above the flange so that in use the light source and the primary optic are recessed within the ceiling structure.

14. A two-component lighting system comprising:

a passive component comprising an elongated optical element;

an active component comprising:

an elongated housing including an exit aperture;

a light element disposed within and along a portion of the length of the elongated housing; and wherein light from the light element is directed toward the passive component; and a suspension mechanism coupled with the active component and the passive component, the suspension mechanism configured to suspend the passive component at a distance from the active component when the active component is disposed within a ceiling, wherein a portion of light incident on the passive component is redirected downward from the passive component, and light redirected 65 to 90 degrees from nadir is less than 15% of the light redirected downward.

15. The two-component lighting system according to claim 14, wherein the light element comprises a plurality of light elements disposed along a portion of the length of the elongated housing.

16. The two-component lighting system according to claim 14, wherein light incident on the passive component is redirected upward from the passive component with a high concentration of light in the angular range from 60 to 85 degrees from zenith.

17. The two-component lighting system according to claim 14, wherein the light element comprises an LED.

18. The two-component lighting system according to claim 14, wherein the active component includes an attachment mechanism configured to retain the active component within the ceiling.

19. The two-component lighting system according to claim 14, wherein the passive component comprises a substantially convex cross-sectional shape relative to the active component.

* * * * *